US007128077B2

(12) United States Patent
Cantwell

(10) Patent No.: US 7,128,077 B2
(45) Date of Patent: Oct. 31, 2006

(54) TENT VENTILATION STRUCTURE

(75) Inventor: Robert R. Cantwell, Leslie, MO (US)

(73) Assignee: North Pole, Limited, Kowloon (HK)

( * ) Notice: Subject to any disclaimer, the term of this patent is extended or adjusted under 35 U.S.C. 154(b) by 223 days.

(21) Appl. No.: 10/728,240

(22) Filed: Dec. 3, 2003

(65) Prior Publication Data

US 2005/0120640 A1 Jun. 9, 2005

(51) Int. Cl.
*E04H 15/14* (2006.01)

(52) U.S. Cl. ..... 135/93; 135/117

(58) Field of Classification Search ..... 135/91, 135/93, 94, 117, 906; 52/63
See application file for complete search history.

(56) References Cited

U.S. PATENT DOCUMENTS

| | | | | |
|---|---|---|---|---|
| 2,230,454 | A * | 2/1941 | Friesner et al. | 135/117 |
| 4,165,757 | A * | 8/1979 | Marks | 135/93 |
| 4,265,261 | A * | 5/1981 | Barker | 135/100 |
| 4,838,293 | A * | 6/1989 | Novak | 135/100 |
| 4,898,085 | A * | 2/1990 | Jarnot | 454/275 |
| 5,301,705 | A | 4/1994 | Zheng | |
| 5,467,794 | A | 11/1995 | Zheng | |
| 5,579,799 | A | 12/1996 | Zheng | |
| 6,763,841 | B1 * | 7/2004 | Cantwell | 135/117 |
| 2005/0000555 | A1 * | 1/2005 | Besse | 135/117 |
| 2005/0045220 | A1 * | 3/2005 | Sumner | 135/117 |
| 2005/0194033 | A1 * | 9/2005 | Holub et al. | 135/156 |

* cited by examiner

*Primary Examiner*—Robert Canfield
(74) *Attorney, Agent, or Firm*—Armstrong Teasdale LLP

(57) ABSTRACT

A tent ventilation structure includes a vent window in proximity to a tent floor, and an awning coupled to a top edge of the vent window configured to extend outward from the tent to a position above the base of the vent window. Advantages of the invention include the ability to ventilate the tent at locations that improve air circulation and the campers' comfort and enjoyment.

19 Claims, 3 Drawing Sheets

TENT VENTILATION STRUCTURE

FIELD

The present invention relates generally to tents, and more particularly to tent ventilation structures.

BACKGROUND

Tents provide temporary shelter to campers and wilderness explorers. However, tents tend to become hot when exposed to the sun during the day and to trap moist air at night. Consequently, the campers' comfort and enjoyment often depends on the quality of the ventilation system employed in the tent structure.

Conventional tents structures are ventilated by screened windows located 18 to 24 inches above the tent floor. Since the campers sleeping in the tent typically lie on or near the tent floor, providing airflow at 18 inches above floor level is not effective in circulating air near the campers and keeping them cool.

One conventional solution to the ventilation problem is to add ground floor vents to the tent. However, the ground vents introduce a different problem, which is a lack of protection from rain and ground water entering the tent through the ground floor vent. Another conventional solution is to provide a vent at or near the top of the tent. While this may allow hot air to exit the tent, it does not provide a structure for cool air to enter the tent and it does not provide for air circulation near the campers at night.

SUMMARY

The invention overcomes the identified limitations and provides a tent ventilation system that circulates air in proximity to the tent floor.

An exemplary embodiment of a tent vent includes a vent window in proximity to the tent floor, and an awning coupled to a top edge of the vent window configured to extend outward from the tent to prevent rain from contacting the vent window.

In one aspect of the invention, the awning is arched.

In another aspect of the invention, the vent window comprises a mesh-type material.

In another aspect of the invention, a bottom edge of the vent window is less than twelve inches from the tent floor when the tent is assembled.

In another aspect of the invention, the awning further includes a flexible outer support member to extend the awning outward from the tent and to define an outer upper edge of the awning.

In another aspect of the invention, the awning further includes a flexible inner support member to define an inner upper edge of the awning.

In another aspect of the invention, the tent further includes a hold rod coupled to the awning and extending outward from the tent configured to hold the awning in an extended position away from the tent.

In another embodiment, a ventilation system for a tent includes a floor tent vent including a vent window in proximity to a tent floor, and an arched awning coupled to a top edge of the vent window and extending outward from the tent to prevent rain from contacting the vent window, and a ceiling tent vent in proximity to a tent ceiling to create air convection with the floor tent vent.

Advantages of the invention include the ability to ventilate the tent at locations that improve air circulation and the campers' comfort and enjoyment.

DRAWINGS

The invention will be described with reference to the drawings, in which.

DETAILED DESCRIPTION

Exemplary embodiments are described herein to provide a detailed description of the invention. Variations of these embodiments will be apparent to those of skill in the art. For example, the invention is described with reference to a collapsible tent, but the invention may also be used in semi-permanent or fixed structures.

Figure 1:
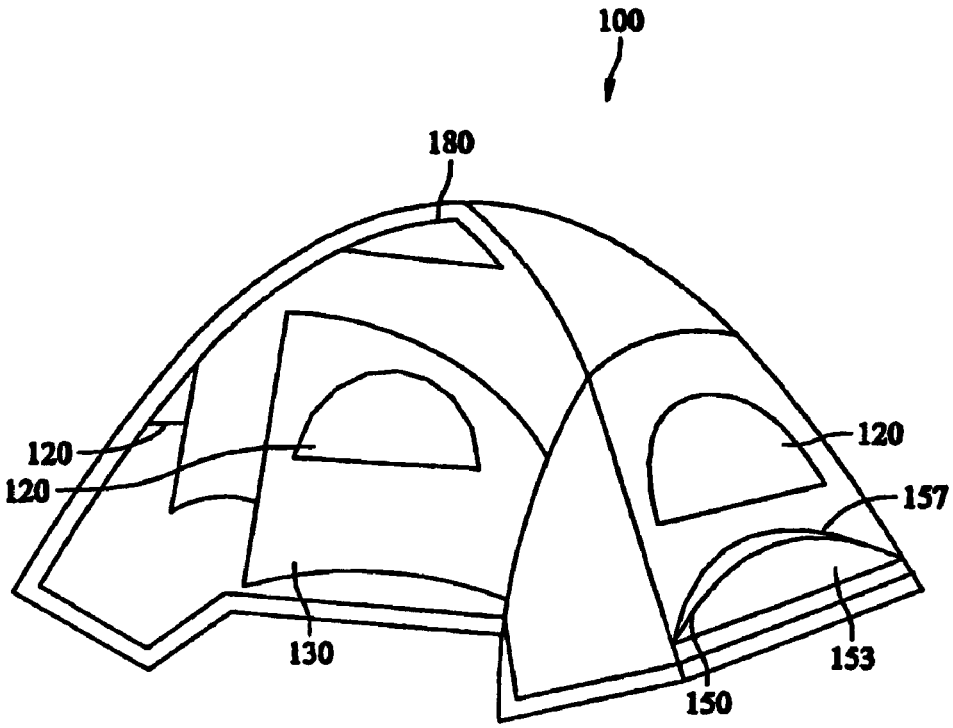
FIG. 1 is a perspective view showing the outside of a tent having a tent vent, according to one embodiment of the invention.

FIG. 1 is a perspective view showing the outside of a tent 100 having a tent vent 150, according to an embodiment of the invention. The tent 100 may be, for example, a collapsible tent such as a camping tent. The tent 100 includes windows 120, a door 130, and the tent vent 150. Referring specifically to the vent 150, it includes a vent window 153 and an arched awning 157. Although the awning 157 shown in FIG. 1 is arched, the awning 157 may be configured in other shapes, such as for example, an elliptical shape. In one embodiment, the tent also includes a ceiling opening 180, which may include mesh fabric, for added air circulation.

In order to improve airflow in the lower portion of the tent, the vent window 153 is in proximity to the floor of the tent 100. For example, the bottom edge of the vent window may be less than twelve inches from the tent floor when the tent is assembled. The arched awning 157 is coupled to the top edge of the vent window and extends outward from the tent to prevent rain from contacting the vent window. By keeping rainwater from contacting the vent window, people sleeping inside the tent are kept dry during rainfall. The vent can be constructed in a variety of sizes, for example, the length of the vent window 153 could be twenty inches and the height of the vent window six inches.

In another embodiment, the floor tent vent 150 is part of a ventilation system for the tent 100. When used in cooperation with the ceiling opening 180, which lies in proximity to the ceiling of the tent 100, air convection is created to provide increased ventilation inside the tent 100.

Figure 2:
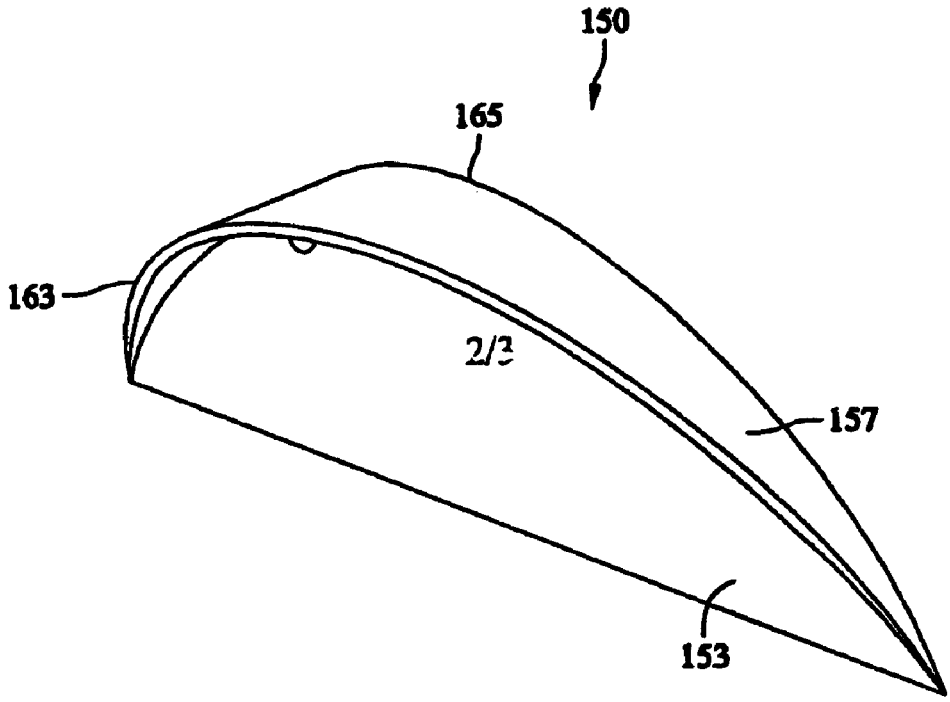
FIG. 2 is a detailed view showing a tent vent, according to one embodiment of the invention.

FIG. 2 is a detailed view showing the tent vent 150. The tent vent includes the vent window 153, the arched awning 157, a flexible outer support member 163, and a flexible inner support member 165. The vent window 153 is constructed from a material that allows air to pass through it such as a mesh or perforated material.

The awning 157 includes the flexible outer support member 163 to extend the awning outward from the tent 100 and to define an outer upper edge of the awning. In one embodiment, the awning 157 includes the flexible inner support member 165 to define and support an inner upper edge of the awning. The flexible outer and inner support members 163 and 165 may be made of any flexible material such as fiberglass.

In one aspect, the vent window 153 is arch-shaped and attached to the arched awning 157 rather than the tent body adjacent the inner support member 165, which provides additional room inside the tent.

FIG. 2 depicts the arched awning 157 protruding a distance from the tent body. The arched awning is coupled to a top edge of the vent window configured to extend outward from the tent to a position above the base of the vent window which avoids foreign materials such as rain from entering the tent. This can create a substantially vertical window or a window that extends beyond vertical away from the tent body.

Figure 3:
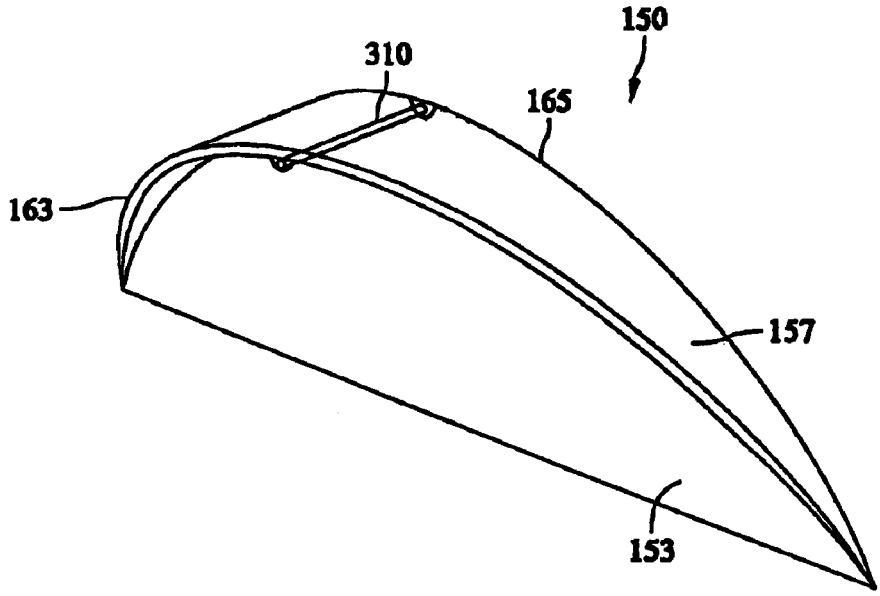
FIG. 3 is a detailed view showing the tent vent with a hold rod, according to another embodiment of the invention.

FIG. 3 is a detailed view showing the tent vent 150 with a hold rod 310 to hold out the awning 157. The tent vent includes the vent window 153, the arched awning 157, the flexible outer and inner support members 163 and 165, and the hold rod 310. The hold rod 310 is coupled to the awning 157 and extends outward from the tent 100 to hold the awning in an extended position away from the tent. In one aspect, the hold rod 310 is coupled to the flexible outer and inner support members 163 and 165. In one aspect, the hold rod 310 can be inserted and removed for assembly and disassembly of the tent 100. For example, the hold rod 310 may couple and decouple with sockets or sleeves attached to a part or parts of the tent 100, such as the flexible outer and inner support members 163 and 165, for easy insertion and removal of the hold rod 310. The hold rod 310 may be constructed of fiberglass or any other suitably rigid and lightweight material.

Since the awning 157 is designed to extend over the base of the window 153, the awning provides rain protection in addition to allowing for improved ventilation in a tent.

Advantages of the invention include the ability to ventilate the tent at locations that improve air circulation and the campers' comfort and enjoyment.

Having disclosed exemplary embodiments and the best mode, modifications and variations may be made to the disclosed embodiments while remaining within the subject and spirit of the invention as defined by the following claims.

The invention claimed is:

1. A ventilation system for a tent structure, the tent structure comprising a plurality of sides each defining a lower portion and an upper portion, the ventilation system comprising:

a vent window formed within the lower portion of a first side of the plurality of sides and in proximity to a tent floor;

an awning coupled to the first side at a top edge of the vent window configured to extend outward from the tent structure to a position above the base of the vent window;

an opening formed within the upper portion of a second side of the plurality of sides and in proximity to a ceiling of the tent structure, the opening cooperating with the vent window for facilitating creating air circulation inside the tent structure;

a mesh material covering the opening; and a window formed within the upper portion of the first side.

2. A ventilation system for a tent structure in accordance with claim 1 wherein the awning is arched.

3. A ventilation system for a tent structure in accordance with claim 1 wherein the vent window comprises a mesh-type material.

4. A ventilation system for a tent structure in accordance with claim 1 wherein a bottom edge of the vent window is less than twelve inches from the tent floor when the tent structure is assembled.

5. A ventilation system for a tent structure in accordance with claim 1 wherein the awning further comprises a flexible outer fiberglass support member configured to extend the awning outward from the tent structure and to define an outer upper edge of the awning.

6. A ventilation system for a tent structure in accordance with claim 5 wherein the awning further comprises a flexible fiberglass inner support member configured to define an inner upper edge of the awning.

7. A ventilation system for a tent structure in accordance with claim 5 wherein the vent window is arch-shaped.

8. A ventilation system for a tent structure in accordance with claim 6 wherein the vent window is arch-shaped.

9. A ventilation system for a tent structure in accordance with claim 6 further comprising a hold rod coupled between the fiberglass outer support member and the fiberglass inner support member and configured to hold the awning in an extended position away from the tent structure.

10. A ventilation system for a tent structure in accordance with claim 1 wherein a length of the vent window is approximately twenty inches and a height of the vent window is approximately six inches.

11. A ventilation system for a tent structure in accordance with claim 7 wherein a length of the vent window is approximately twenty inches and a height of the vent window is approximately six inches.

12. A ventilation system for a tent structure in accordance with claim 8 wherein a length of the vent window is approximately twenty inches and a height of the vent window is approximately six inches.

13. A ventilation system for a tent structure, the tent structure comprising a plurality of sides each defining a lower portion and an upper portion, the ventilation system comprising:

a floor tent vent comprising a vent window formed within the lower portion of a first side of the plurality of sides and in proximity to a tent floor, and an awning coupled to the first side at a top edge of the vent window and extending outward from the tent structure to a position above the base of the vent window; and an opening formed within the upper portion of a second side of the plurality of sides and in proximity to the tent ceiling to create air convection with the floor tent vent, a mesh material covering the opening.

14. A ventilation system for a tent structure in accordance with claim 13 wherein the awning is arched.

15. A ventilation system for a tent structure in accordance with claim 13 wherein the vent window comprises a mesh-type material.

16. A ventilation system for a tent structure in accordance with claim 13 wherein a bottom edge of the vent window is less than twelve inches from the tent floor when the tent structure is assembled.

17. A ventilation system for a tent structure in accordance with claim 15 wherein a bottom edge of the vent window is less than twelve inches from the tent floor when the tent structure is assembled.

18. A ventilation system for a tent structure in accordance with claim 13 wherein the awning further comprises:

a flexible outer fiberglass support member configured to extend the awning outward from the tent structure and to define an outer upper edge of the awning;

a flexible fiberglass inner support member configured to define an inner upper edge of the awning; and a hold rod coupled between the fiberglass outer support member and the fiberglass inner support member and configured to hold the awning in an extended position away from the tent structure.

19. A ventilation system for a tent structure, the tent structure comprising a plurality of sides each defining a lower portion and an upper portion, the ventilation system comprising:

a vent window formed within the lower portion of a first side of the plurality of sides and in proximity to a tent floor; and an awning coupled to the first side at a top edge of the vent window configured to extend outward from the tent structure to a position above the base of the vent window, the awning comprising:

a flexible outer fiberglass support member configured to extend the awning outward from the tent structure and to define an outer upper edge of the awning;

a flexible fiberglass inner support member configured to define an inner upper edge of the awning; and a hold rod coupled between the fiberglass outer support member and the fiberglass inner support member and configured to hold the awning in an extended position away from the tent structure.

* * * * *